US008369751B2

(12) United States Patent
Ichikawa et al.

(10) Patent No.: US 8,369,751 B2
(45) Date of Patent: Feb. 5, 2013

(54) CONVEYOR, DEVELOPER CARTRIDGE, AND FILLING METHOD

(75) Inventors: Hideo Ichikawa, Ebina (JP); Hirokazu Murase, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 591 days.

(21) Appl. No.: 12/252,868

(22) Filed: Oct. 16, 2008

(65) Prior Publication Data

US 2009/0129821 A1 May 21, 2009

(30) Foreign Application Priority Data

Oct. 30, 2007 (JP) ..... 2007-282256

(51) Int. Cl.
*G03G 15/08* (2006.01)

(52) U.S. Cl. ..... 399/254; 399/120; 399/263

(58) Field of Classification Search ..... 399/120, 399/254, 256, 258, 263
See application file for complete search history.

(56) References Cited

U.S. PATENT DOCUMENTS

| | | | | |
|---|---|---|---|---|
| 4,610,068 | A | 9/1986 | Schultz | 29/418 |
| 5,146,277 | A | 9/1992 | Fox et al. | 355/245 |
| 5,629,758 | A | 5/1997 | Kageyama et al. | 399/263 |
| 2007/0041748 | A1 * | 2/2007 | Ikeda | 399/253 |
| 2007/0048023 | A1 * | 3/2007 | Thompson et al. | 399/254 |

FOREIGN PATENT DOCUMENTS

| | | |
|---|---|---|
| JP | 58-127961 | 7/1983 |
| JP | 02-110481 | 4/1990 |
| JP | 07-168432 | 7/1995 |
| JP | 10-247009 | 9/1998 |
| JP | 2000-305344 | 11/2000 |
| JP | 2002-268344 | 9/2002 |
| JP | 2004-264539 A | 9/2004 |
| JP | 2006-053446 | 2/2006 |

* cited by examiner

*Primary Examiner* — David Gray
*Assistant Examiner* — Joseph S Wong
(74) *Attorney, Agent, or Firm* — Morgan, Lewis & Bockius LLP

(57) ABSTRACT

A conveyor includes a rotation shaft and a plurality of convey members provided along an axial direction of the rotation shaft, wherein at least one part of the plurality of convey members is an arc convey member that includes: an arc part having an outer periphery that forms an arc forming a part of a spiral so that an angle between two perpendiculars extended from two ends of the arc is smaller than 360°; and a support part that supports the arc part, with the outer periphery of the arc part inclined to the axial direction of the rotation shaft.

10 Claims, 7 Drawing Sheets
(1 of 7 Drawing Sheet(s) Filed in Color)

CONVEYOR, DEVELOPER CARTRIDGE, AND FILLING METHOD

CROSS-REFERENCE TO RELATED APPLICATIONS

This application claims priority under 35 USC 119 from a Japanese patent application No. 2007-282256 filed on Oct. 30, 2007.

BACKGROUND

1. Technical Field

The present invention relates to a conveyor for conveying a developer, a developer cartridge, and a method for filling a developer into the developer cartridge.

2. Related Art

In an image forming device which develops an image with use of a developer, an attachable/detachable developer cartridge is used as a consumable supplies for charging a developing device with a developer. The developer cartridge is called, for example, a toner cartridge and has a cylindrical container body and a conveyor contained in the container body. The conveyor is formed by spirally winding a wire to fit in an inner diameter of the container body. As the conveyor is rotated in a constant direction, the conveyor conveys a developer contained in the container body to a discharge port provided at an end of the container body, while agitating the developer. The developer discharged out of the discharge port is refilled into the developing device.

SUMMARY

According to one aspect of the invention, there is provided a conveyor including a rotation shaft and a plurality of convey members provided along an axial direction of the rotation shaft, wherein at least one part of the plurality of convey members is an arc convey member that includes: an arc part having an outer periphery that forms an arc forming a part of a spiral so that an angle between two perpendiculars extended from two ends of the arc is smaller than 360°; and a support part that supports the arc part with the outer periphery of the arc part inclined towards the axial direction of the rotation shaft.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

An exemplary embodiment of the invention will be described in detail based on the following figures, wherein.

DETAILED DESCRIPTION

Hereinafter: an exemplary embodiment of the invention will be described with reference to the drawings.

1. Structure 1-1. Overall Structure of Developer Cartridge 10

Figure 1:
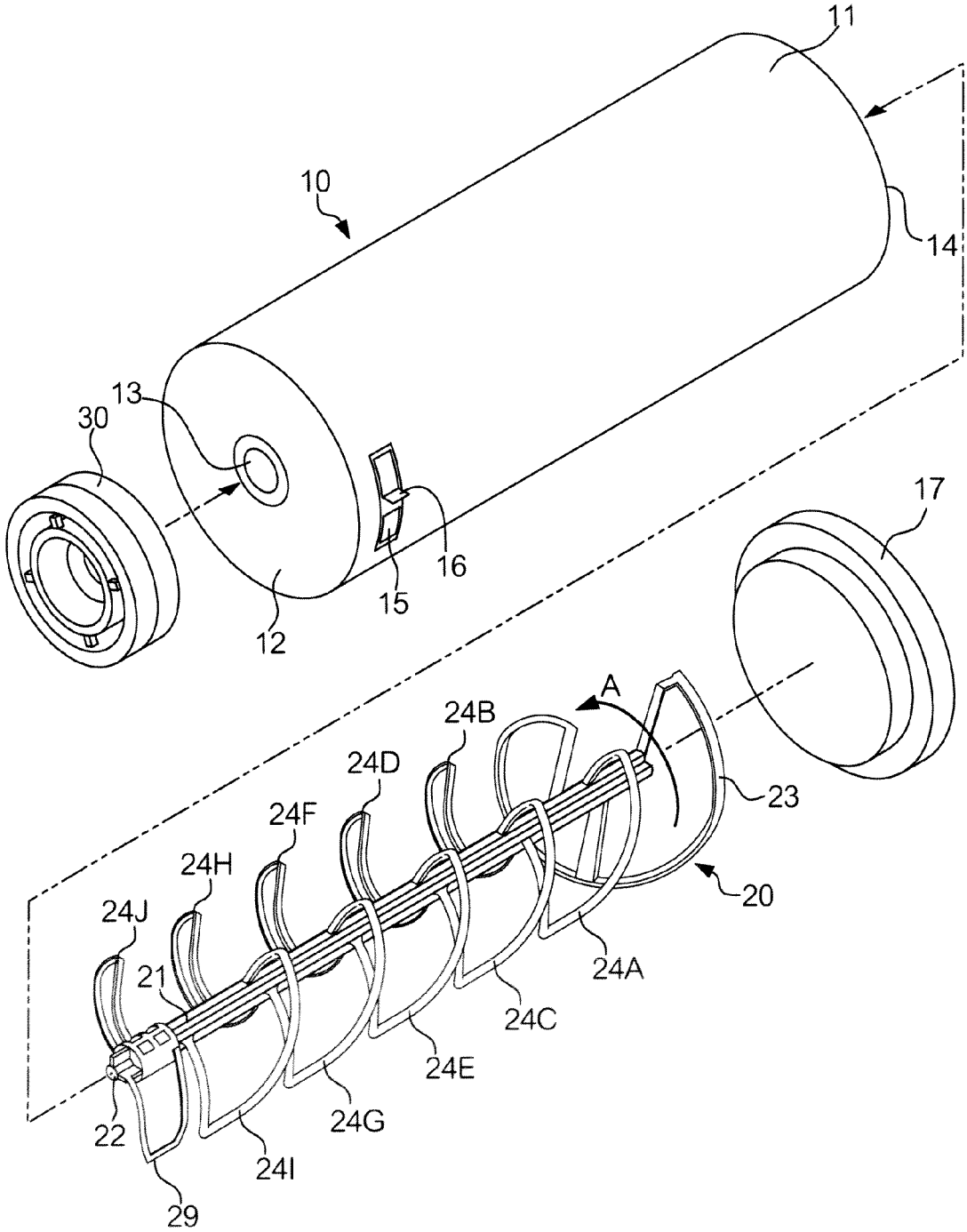
FIG. 1 is an exploded perspective view showing a developer cartridge according to an exemplary embodiment of the invention.

FIG. 1 is an exploded perspective view which illustrates the structure of the developer cartridge 10.

The developer cartridge 10 includes a container body 11, a cap member 17, a conveyor 20, and a coupling 30. The developer cartridge 10 is configured to be attachable or detachable to/from an image forming device (not shown in the figures). The container body 11 is a bottomed cylindrical member which is formed from paper or plastics. A container chamber is formed by inner wall surfaces of the container body 11, and a powdery developer is contained in the container chamber. A hole 13 is formed in a bottom 12 of the container body 11. The coupling 30 is partially inserted in the hole 13. In a circumference of an end of the container body 11 which is close to the bottom 12, a developer outlet port 15 is provided to feed a developer to a reservoir tank (not shown in the figures) of the developing device. A shutter 16 which is reciprocally movable in circumferential directions of the container body 11 is provided near the developer outlet port 15. This shutter 16 is closed while the developer cartridge is not attached to the image forming device. While the developer cartridge 10 is attached to the image forming device, the shutter 16 is open. As the cap member 17 is inserted or engaged in an opening 14 of the container body 11, the opening 14 is closed so that the container chamber in the developer cartridge 10 is enclosed.

The container body 11 contains a conveyor 20 having a length which is substantially equal to the longitudinal length of the container chamber in the container body 11. The conveyor 20 is formed by integrally molding high-density polyethylene or low-density polyethylene into a shape which is totally spiral. An end of a rotation shaft 21 of the conveyor 20 is connected to the coupling 30 partially inserted in the hole 13. As the coupling 30 is rotated in an arrow direction A by a drive device (not shown in the figures) such as a motor for the conveyor 20, the conveyor 20 connected to the coupling 30 accordingly rotates in the arrow direction A.

1-2. Structure of Conveyor 20

The structure of the conveyor 20 will now be described in detail with reference to FIG. 1 and FIG. 2 which is a cross-sectional view of the developer cartridge 10.

The conveyor 20 includes the rotation shaft 21, plural scrape/convey members 23, and arc convey members 24A to 24J. The rotation shaft 21 has a cross-shaped section. The plural scrape/convey members 23 are provided, disposed along an axial direction of the rotation shaft 21. At an end of the rotation shaft 21, there is provided an attachment part 22 where the coupling 30 is attached. Along an axial direction of the rotation shaft 21, the developer is conveyed from a side where the attachment part 22 is not provided to a side where the attachment part 22 is provided. That is, the end of the rotation shaft 21 where the attachment part 22 is not provided is positioned in an upstream side along the conveying direction of the developer. This end will therefore be hereinafter referred to as an "upstream end". On the other hand, the opposite end where the attachment part 22 is provided is positioned in a downstream side along the conveying direction of the developer. This end will therefore be hereinafter referred to as a "downstream end".

The scrape/convey member 23 and the arc convey members 24A to 24J are arranged, in a staggered manner on both sides of the rotation shaft 21. The scrape/convey members 23 are provided on the rotation shaft 21 at an upstream end of the shaft 21. The arc convey members 24A to 24J are provided in a downstream side of the scrape/convey member 23 along the conveying direction. Accordingly, the scrape/convey members 23 have a slightly different function from that of the arc convey members 24A to 24J. Specifically, the scrape/convey members 23 function so as to scrape a developer compacted in an area close to the upstream end of the rotation shaft 21 and to simultaneously convey the developer in a direction toward the downstream end, while agitating the developer. On the other hand, the arc convey members 24A to 24J function to convey, in a direction toward the downstream end, the developer which has been conveyed to the position of each of the arc convey members 24A to 24J by another one or ones of the arc convey members existing in the upstream side of each of the arc convey members along the conveying direction, while agitating the developer.

Figure 2:
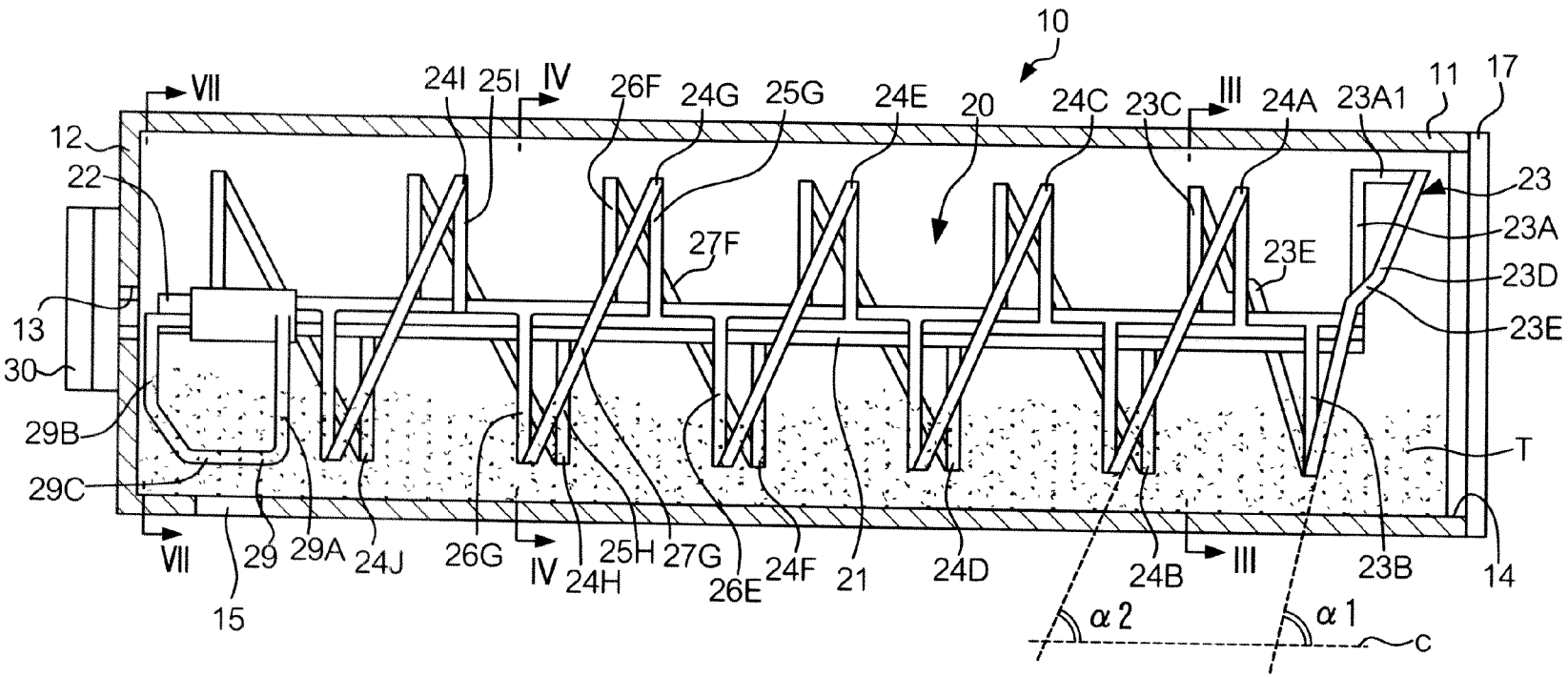
FIG. 2 is a cross-sectional view of a developer cartridge.

In view of such a difference in function, an arc part 23D of the scrape/convey member 23 is configured to have a greater inclination angle $\alpha 1$ to an axial direction c of the rotation shaft 21 than an angle $\alpha 2$ of arc parts 27 of the arc convey members 24 to the axial direction c of the rotation shaft 21, as shown in FIG. 2. This is because a greater inclination angle is desirable where scraping performance is prioritized. The arc part 27 of the scrape/convey member 23 is supported at a more distant position from the rotation shaft 21 than that of the arc part 27 of each arc convey member 24 from the rotation shaft 21. This is because a support at a more distant position to the rotation shaft 21 is also desirable in order that outer peripheries of the arc parts 27 reach the inner wall surface of the container chamber when scraping performance is prioritized. Hereinafter, where the scrape/convey member 23 need not particularly be distinguished from the arc convey members 24A to 24J in the descriptions made below, both members will be together referred to as convey members 23 and 24. Similarly, the arc convey members 24A to 24J will be together referred to as arc convey members 24 where these members need not particularly be distinguished from each other in the descriptions made below.

At a position of the rotation shaft 21 which is closest to the downstream end of the rotation shaft 21, a protrusion member 29 is provided so as to protrude from the rotation shaft 21. The protrusion member 29 is substantially U-shaped and functions to push out, through the developer outlet port 15 to the outside, a developer which finally stays near the developer outlet port 15 after having been conveyed from the upstream side to the downstream side along the conveying direction, while loosening the developer.

Figure 3:
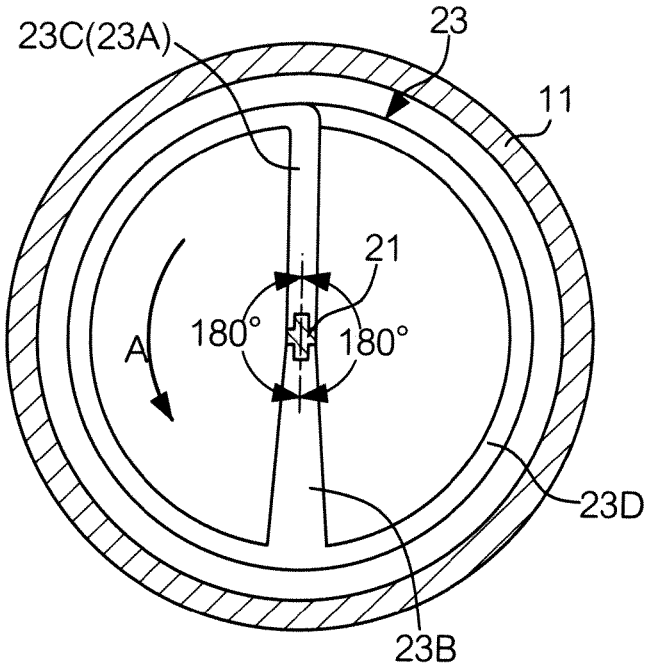
FIG. 3 is a cross-sectional view of a main part, cut along a direction defined by arrows III in FIG. 2.
Figure 4:
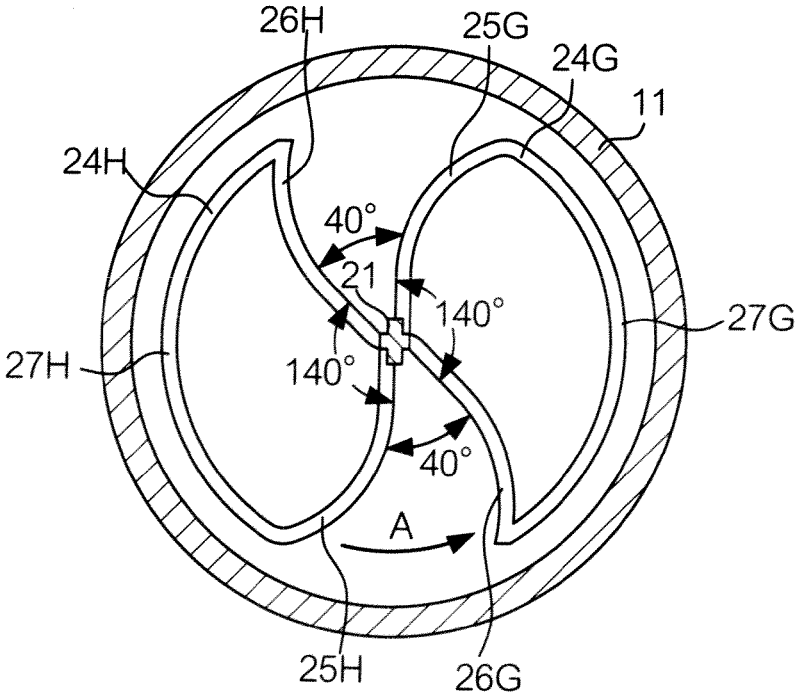
FIG. 4 is a cross-sectional view of a main part, cut along a direction defined by arrows VI in FIG. 2.

Next, FIG. 3 is a cross-sectional view of a main part cut along a direction defined by arrows III and III in FIG. 2, and depicts a structure of the scrape/convey member 23. FIG. 4 is a cross-sectional view of a main part cut along a direction defined by arrows IV and IV in FIG. 2, and depicts a structure of the arc convey members 24.

1-3. Structure of Scrape/Convey Member 23

The structure of the scrape/convey member 23 will now be described with reference to those figures.

As shown in FIG. 3, the scrape/convey member 23 includes an arc part 23D and support parts 23A to 23C. The arc part 23D has an outer periphery forming a spiral arc. The support parts 23A to 23C support the arc part 23D, with outer peripheries of the arc part 23D inclined to an axial direction of the rotation shaft 21 (see FIG. 2). The rotation shaft 21, the arc part 23D, and each of the support parts 23A to 23C are rod-like members which respectively have predetermined thicknesses. There is a gap between each of the rotation shaft 21, arc part 23D, and support parts 23A to 23C. The support parts 23A to 23C are respectively a first support part 23A, an intermediate support part 23B, and a second support part 23C. The first support part 23A is a substantially linear member which is provided at the upstream end of the rotation shaft and extends in a direction perpendicular to the rotation shaft 21. The intermediate support part 23B is also a substantially linear member, which is positioned in the downstream side of the first support part 23A along the conveying direction and is rotated clockwise by 180° from the first support part 23A in the rotation direction of the rotation shaft 21. The second support part 23C is also a substantially linear member, which is positioned in the downstream side of the intermediate support part 23B along the conveying direction and is rotated clockwise by 180° from the intermediate support part 23B in the rotation direction of the rotation shaft 21.

A top end of the first support part 23A supports an end of the arc part 23D, and a top end of the second support part 23C supports another end of the arc part 23D. A top end of the intermediate support part 23B supports a center area of the arc part 23D. As described above, the position of the intermediate support part 23B is positioned, rotated clockwise by 180° from the first support part 23A. The second support part 23C is positioned, rotated clockwise by 180° from the intermediate support part 23B. Accordingly, the arc part 23D has a spiral shape having an arc whose angular aperture is 360°. The term "angular aperture" refers to an angle between two perpendiculars extended to the rotation shaft 21 from two ends of the arc when viewed in a direction parallel to the rotation shaft 21. That is, 360° is an angle between two perpendiculars extended from two ends of the arc part 23D to the rotation shaft 21.

In the arc part 23D, step parts 23E are further provided respectively between the first support part 23A and the intermediate support part 23B and between the intermediate support part 23B and the second support part 23C. The first support part 23A has a protrusion part 23A1 which protrudes toward the upstream side (rightwards in the figure) from the position of the upstream end of the rotation shaft 21. The top end of the protrusion part 23A1 supports the arc part 23D. The protrusion part 23A1 protrudes by a dimension substantially equal to a distance from the upstream end of the rotation shaft 21 to the intermediate support part 23B.

1-4. Structure of the Arc Convey Member 24

Next, the structure of the arc convey members 24 will be described.

As shown in FIG. 4, each of the arc convey members 24 are constituted of an arc part 27, a first support part 25, and a second support part 26. The arc part 27 has an outer periphery forming an arc which forms part of a spiral. The first support part 25 and the second support part 26 support the arc part 27 with the arc part 27 inclined towards an axial direction of the rotation shaft 21 (see FIG. 2). The rotation shaft 21, arc part 27, support parts 25, and second support parts 26 are rod-like members. There is a gap between each of the rotation shaft 21, arc part 27, first support parts 25, and second support parts 26. In FIG. 4, alphabetic letters appended to reference numerals correspond respectively to alphabetic letters appended to those of the arc convey members 24A to 24J. Those appended alphabetic letters indicate that members denoted at those letters are respectively components of corresponding arc convey members 24A to 24J.

Each of the first support part 25 is provided in a side that is closer to the upstream end of the rotation shaft 21 than a corresponding second support part 26. Each of the second support part 26 is provided in a side that is closer to the downstream end of the rotation shaft 21 than a corresponding first support part 25, and is rotated clockwise by 140° from the corresponding first support part 25. That is, each first support part 25 supports a corresponding arc part 27 in the upstream side along the rotation direction of the rotation shaft 21 while each second support part 26 supports a corresponding arc part 27 in the downstream side along the rotation direction of the rotation shaft 21. Unlike the first support part 23A, intermediate support part 23B, and second support part 23C, the first support parts 25 and second support parts 26 are bowed out so as to expand toward the downstream side along the rotation direction of the rotation shaft 21.

A top end of each of the first support part 25 supports an end of a corresponding arc part 27, and a top end of a corresponding second support part 26 supports another end of the corresponding arc part 27. Each arc part 27 therefore has a spiral shape forming an arc whose angular aperture is 140°. That is, 140° is an angle between two perpendiculars extended from two ends of each arc part 27. Accordingly, no arc part 27 exists in areas corresponding to an angular aperture of 40° centered on the rotation shaft 21 when viewed in a direction parallel to the axial direction of the rotation shaft 21. Further, the first support part 25 and the second support part 26 of each arc convey member 24 form a positional relationship such that all adjacent arc convey members 24 partially overlap each other when viewed in a direction vertical to the rotation shaft 21. The arc convey member 24G will now be described by an example. The first support part 25G of the arc convey member 24G is provided between the second support part 26F of an adjacent arc convey member 24F in the upstream side along the conveying direction and the second support part 26E of a second adjacent arc convey member 24E in a further upstream side along the conveying direction. The second support part 26G of the arc convey member 24G is provided between the first support part 25H of an adjacent arc convey member 24H in the downstream side along the conveying direction and the first support part 25I of a second adjacent arc convey member 24I in a further upstream side along the conveying direction. Between the scrape/convey member 23 and an arc convey member 24 adjacent to the member 23, there exists a relationship similar to the aforementioned relationship such that all of the adjacent arc convey members 24 partially overlap each other when viewed in a direction vertical to the rotation shaft 21.

FIG. 5 are enlarged perspective views of parts where the rotation shaft 21 connects with a first support part 25 and a second support part 26.

Figure 5A:
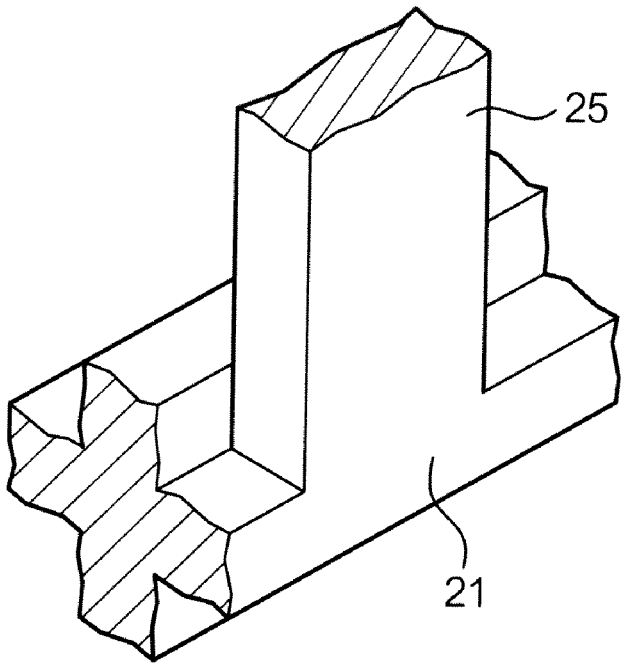
FIG. 5 is an enlarged perspective view of a part where a rotation shaft 21 makes contact with a first support part 25.
Figure 5B:
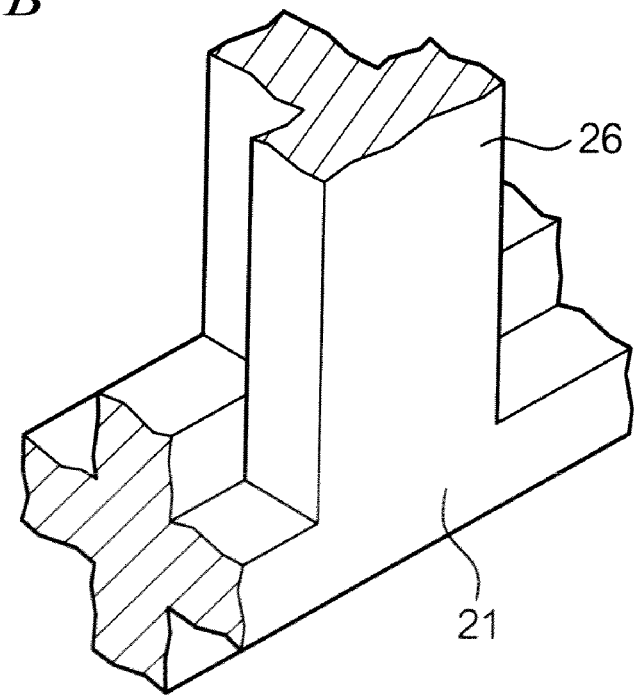

As shown in FIG. 5A, the first support part 25 is connected to the rotation shaft 21 so that the first support part 25 stands up from an edge piece of the rotation shaft 21 (e.g., one of the edge pieces extending in cross directions from the center). On the other hand, as shown in FIG. 5B, the second support part 26 is also connected to the second support part 26 so that the second support part 26 bridges two edge pieces of the rotation shaft 21. Further, the first support part 25 has an "I-shaped" cross-section while the second support part 26 has a "T-shaped" cross-section. Therefore, the connection part where the second support part 26 is connected to the rotation shaft 21 is thicker and accordingly has greater strength compared to that of a connection part where the first support part 25 is connected to the rotation shaft 21. As a result, the connection part between the second support part 26 and the rotation shaft 21 is stronger than that between the first support part 25 and the rotation shaft 21.

Thus, the connection part between each second support part 26 and the rotation shaft 21 is configured to be stronger because bending stress is concentrated on each second support part 26 which is positioned in the downstream side of a corresponding first support part 25 along the conveying direction when conveying a developer.

Figure 6:
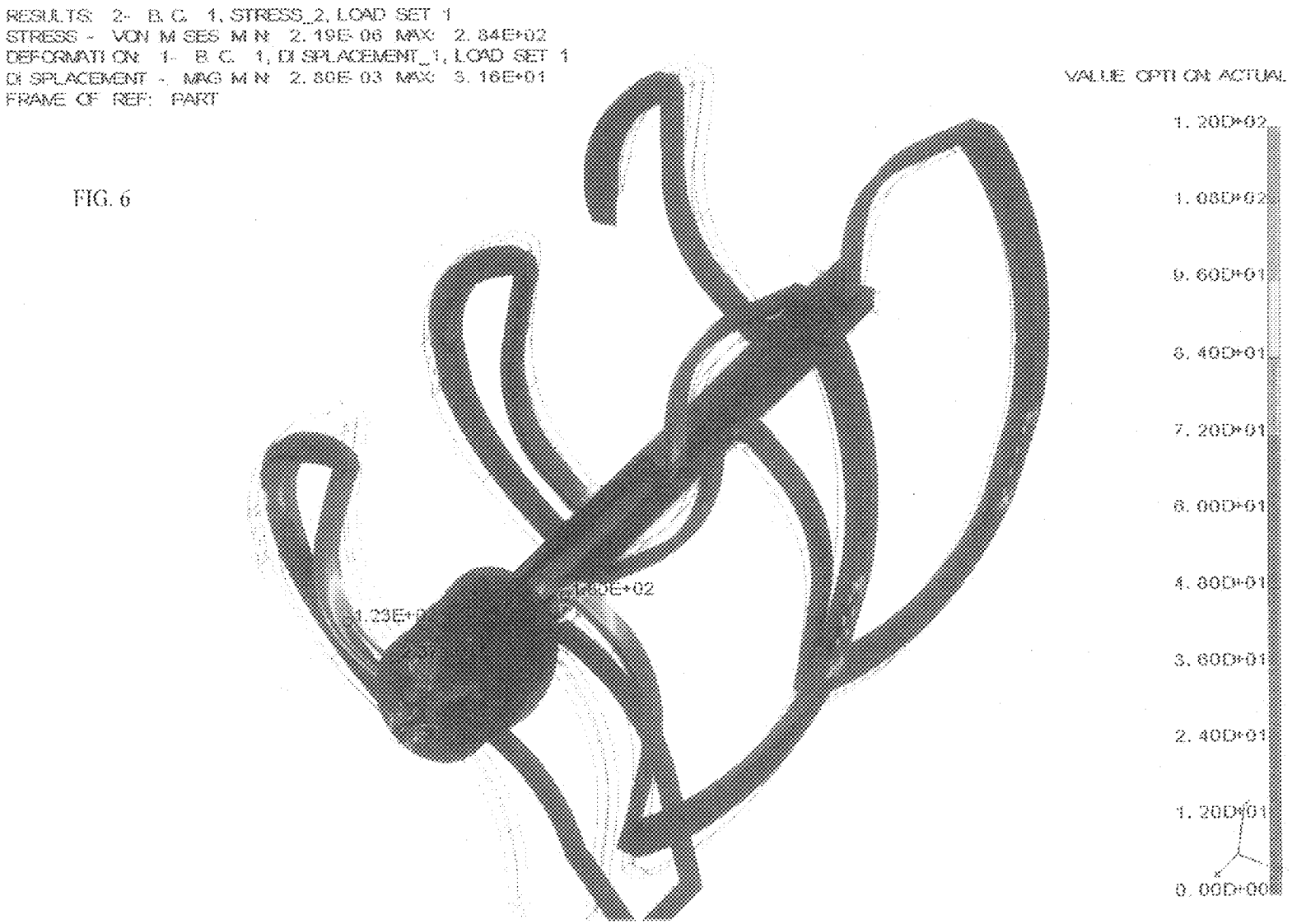
FIG. 6 shows a result of simulating sizes of force applied to support parts.

FIG. 6 shows a result of simulating sizes of stress applied to first support parts 25. A color copy of FIG. 6 will be filed as a separate drawing.

In the figure, particularly great stress is generated at hatched parts F1, F2, and F3 of the second support parts 26J, 26I, and 26H (colored in red in a color copy of the figure). Thus, greater stress is generated at the hatched parts, which acts on the first support parts 25 more than on the second support parts 26. Further, the closer to the downstream end a second support part 26 is, the greater the stress acting on the second support part 26 is. Reasons for the foregoing are discussed as follows. For example, even when an amount of a developer increases in an area close to the upstream end, a relatively large space exists in the downstream side of the area. Owing to the relatively large space, the developer can be conveyed without applying great stress on the first support parts 25 or the second support part 26. On the contrary, when an amount of the developer increases in an area close to the downstream end, the developer is not conveyed to the downstream side but remains in the downstream end and is compacted in an area because only a small space exists to convey the developer further to the downstream side. The first support parts 25 and the second support parts 26 receive a reaction force from the compacted developer. The size of the reaction force acting on each second support part 26 existing in the downstream side of a corresponding first support part 25 is greater than that of the reaction force acting on the corresponding first support part 25. Therefore, greater stress is generated which acts on the second support parts 26. Further, the closer to the downstream end a second support part 26 is, the greater is the generated stress acting on the second support part 26.

Therefore, connection parts between the rotation shaft 21 and the second support parts 26 of several arc convey members which exist in the downstream side among the plural arc convey members 24A to 24J are desirably reinforced so as to improve strength, compared with connection parts between the rotation shaft 21 and the first support parts 25 of several arc convey members 24 which exist in the upstream side along the conveying direction. In case of FIG. 2, for example, the several arc convey members 24 which exist in the upstream side are the arc convey members 24I and 24J.

1-5. Structure of Protrusion Member 29

Next, the structure of the protrusion member 29 will be described.

As shown in FIG. 2, the protrusion member 29 is provided at a position where the protrusion member 29 is directly opposite to the developer outlet port 15 when the conveyor 20 is contained in the vessel body 11. When viewed in a direction vertical to the rotation shaft 21, the arc convey member 24J provided on the rotation shaft 21 in the most downstream side along the conveying direction overlaps at least a part of the protrusion member 29.

Figure 7:
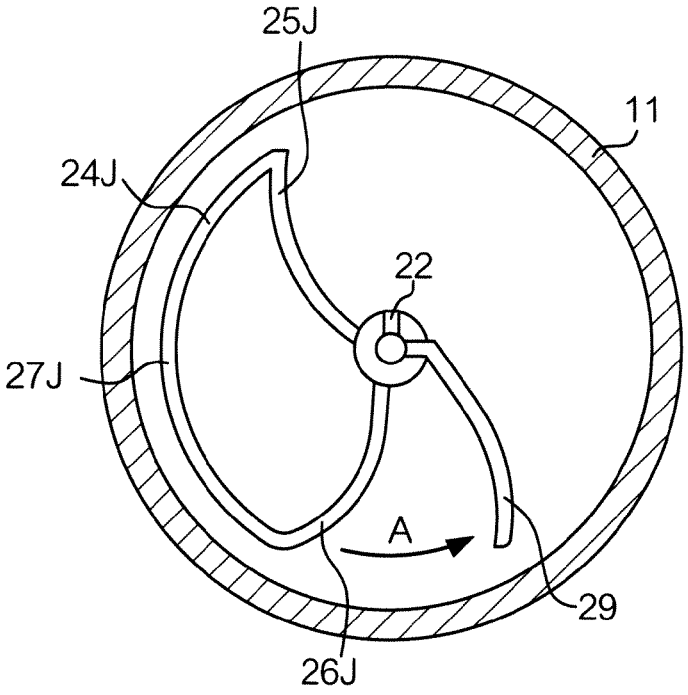
FIG. 7 is a cross-sectional view of a main part, cut along a direction defined by arrows V in FIG. 2.

FIG. 7 is a cross-sectional view of a main part cut along a direction defined by arrows VII-VII in FIG. 2 and depicts a structure of the protrusion member 29. As shown in FIG. 2, the protrusion member 29 has a pair of support parts 29A and 29B, and a substantially linear supported part 29C which are connected to ends of the support parts 29A and 29B. As shown in FIG. 7, the support parts 29A and 29B are bowed so as to expand toward the downstream side along the rotation direction of the rotation shaft 21, like the first support parts 25 and second support parts 26 of the arc convey members 24. The support parts 29A and 29B are bowed to substantially equal extents, and overlap each other as shown in FIG. 7 when viewed in a direction parallel to the rotation shaft 21.

2. Operation of Conveyor 20

Figure 8:
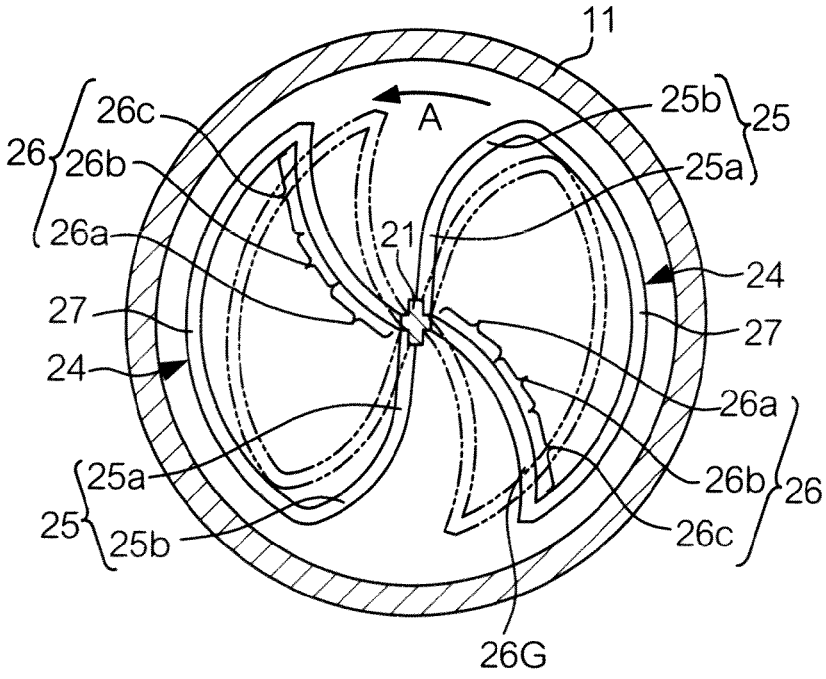
FIG. 8 is a view illustrating deformation of convey members.

Next, an operation of the conveyor 20 will be described with reference to FIGS. 8 and 9.

As has been described above, the first support parts 25 and second support parts 26 of the arc convey members 24, as well as the support parts 29A and 29B of the protrusion member 29, are bowed so as to expand in the rotation direction of the rotation shaft 21. The reason why these parts are bowed will be described below referring to the first support parts 25 and second support parts 26 of the arc convey members 24, as examples.

The first support parts 25 and second support parts 26 are bowed so as to expand in the rotation direction of the rotation shaft 21. Therefore, when external force is applied to the support parts 25 and 26, the support parts 25 and 26 are easily bent in a direction in which bowing is exaggerated. That is, bending stress acts on the support parts 25 and 26, so that the support parts 25 and 26 tilt down in a direction opposite to the rotation direction of the rotation shaft 21. The arc convey members 24 are accordingly deformed as a whole in a direction approaching the rotation shaft 21.

Depending on the extent of bowing, each of the first support part 25 can be further divided into partial units, i.e., a first part 25*a*, a second part 25*b*, and a third part 25*c*, as shown in FIG. 7. The first part 25*a* is not substantially bowed but simply extends in a direction perpendicular to the rotation shaft 21. The second part 25*b* is closer to the top end of the first support part 25 and is more bowed than the first part 25*a*. The third part 25*c* is not substantially bowed. The bending stress is concentrated on the second part which is most bowed. The first support part 25 tends to be bent mainly around the second part 25*b*. Each second support part 26 has the same tendency.

Figure 9A:
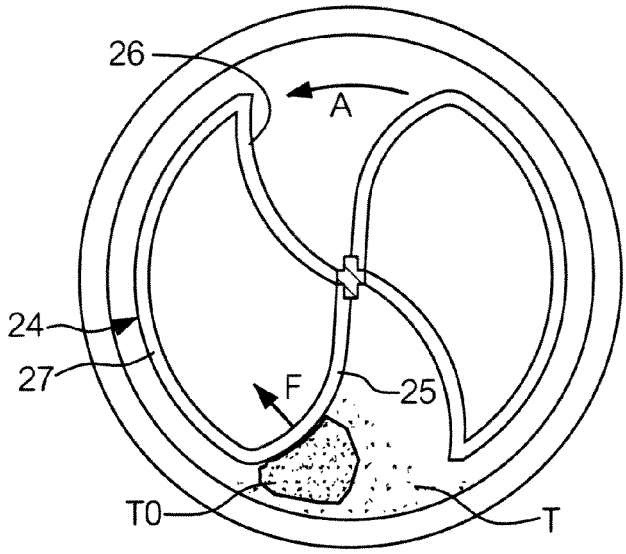
FIG. 9 is a view illustrating deformation of convey members.
Figure 9B:
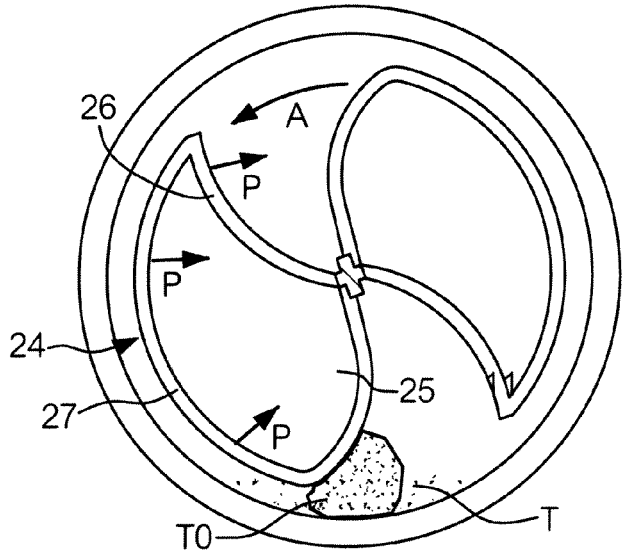
Figure 9C:
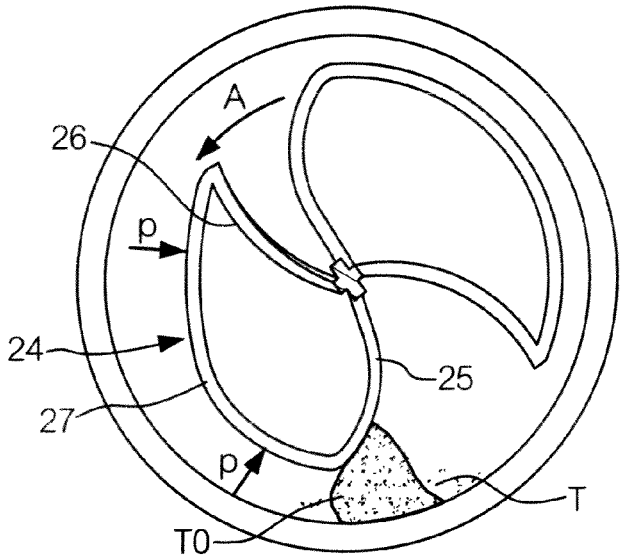

Deformation as described above will now be explained in detail with reference to FIGS. 9A to 9C.

When conveying a developer T by rotating the conveyor 20 in a direction of an arrow A reaction force F is applied to each of the arc convey members 24 from the developer T to be conveyed. The direction of the reaction force F is against the rotation direction A. If the arc convey members 24 are formed of a resin material which can be more easily deformed than metal, deformation easily takes place due to the reaction force F from the developer T. An example will now be described supposing a case that the arc convey members 24 make contact with a lump of developer T0 (see FIG. 9A). In this case, the first support parts 25 and second support parts 26 are bent centered particularly on the second parts 25*b* and 26*b*, so as to tilt down in a direction (the direction of an arrow p in the figure) of approaching the rotation shaft 21. As the conveyor 20 rotates further, the second parts 25*b* and 26*b* are further bent in the direction of the arrow p (see FIG. 9C). In this manner, the arc parts 27 are brought into a state such that the diameter of arcs formed by the arc parts 27 is reduced around the rotation shaft 21 as a center.

Load against rotation of the conveyor 20 can be reduced by reducing the diameter of the conveyor 20 in a manner described above. In a case of using a conveyor having a spiral shape in which the conveyor is spirally wound to fit an inner diameter of a container body, according to related art, a part forming the spiral shape is deformed in a direction of moving apart from a rotation shaft, due to load which acts against rotation of the conveyor. Consequently, the part forming the spiral shape interferes with the inner walls of a container chamber. However, this exemplary embodiment achieves an effect of avoiding such interference.

More specifically, in the case of using a conveyor formed by spirally winding a wire to form a spiral which fits an inner diameter of a container chamber, according to related art, load torque is generated against rotation of the conveyor when a lump of developer makes contact with the conveyor. The load torque acts to enhance the diameter of the spiral of the conveyor. As the diameter of the spiral increases, an outer periphery of the conveyor touches an inner wall of the container chamber. If the load torque acting on the conveyor further exceeds rotation torque of the conveyor, the conveyor stops rotating. On the other hand, in the conveyor 20 according to this exemplary embodiment, the support parts 25 and 26 are bent so that the arc parts 27 tilt down toward the rotation shaft 21 even when a lump of developer makes contact with the arc convey members 24, thereby generating load torque against rotation of the conveyor. Accordingly, the diameter of a spiral formed by the conveyor 20 is not enhanced. As a result, there is a smaller risk that the arc convey members 24 interfere with the inner wall of the container chamber, and a situation of causing the conveyor 20 to stop rotating occurs with more difficulty.

The reasons why the first support parts 25 and second support parts 26 of the arc convey members 24 are bowed have been described above. The support parts 29A and 29B of the protrusion member 29 are bowed for the same reasons as those described above. On the other hand, the first support part 23A, intermediate support part 23B, and second support part 23C of the scrape/convey member 23 are not bowed because these parts need to be greatly deformable in order to scrape out a developer from the corners of the container chamber.

3. Method for Filling Developer

Next, a method of filling an adequate amount of developer into the developer cartridge 10 described above will be explained.

When filling a developer into the developer cartridge 10, the arc convey members 24 are used as a guideline for evaluating an amount of developer to fill. The container body 11 is supposed to be set in a position such that the rotation shaft 21 of the conveyor 20 contained in the container chamber is arranged vertically and the developer outlet port 15 is positioned in a lower side in the direction of a gravitational force. The container chamber in the container body 11 is filled with an amount of developer such that the whole arc convey members 24 are not buried when the container body 11 is maintained in the position. If the developer cartridge 10 filled with such an amount of developer is stocked with the developer outlet port 15 maintained in the lower side, the developer moves to the downstream side along the conveying direction. On the other hand, if the developer cartridge 10 is stocked with the developer outlet port 15 maintained in an upper side, the developer moves to the upstream side along the conveying direction. When the developer has moved to and stays in the upstream side, influence of a reaction force which acts on the conveyor 20 from the developer increases so that it is more than when the developer has moved and stays in the downstream side. Accordingly, if the developer cartridge 10 is stocked with the developer outlet port 15 maintained in the lower side, the arc convey members 24 are desirably provided in an area where the developer stays. That is, more of the developer should desirably exist in an area where the arc convey members 24 having higher conveyance ability than the scrape/convey member 23 exist. Even if the arc convey members 24 receive a reaction force from the developer, the arc convey members 24 bend so as to tilt down in a direction of approaching the rotation shaft 21. Therefore, a load against rotation of the conveyor 20 can be reduced.

On the contrary, the scrape/convey member 23 may be used as a guideline for evaluating an amount of developer to be filled. In this case, the container body 11 is also supposed to be maintained in a position such that an axial direction of the rotation shaft 21 contained in the container chamber is arranged vertically and the developer outlet port 15 is positioned in the lower side in the direction of gravitational force. The container chamber is filled with an amount of developer with which there is no developer in an area where the scrape/convey member 23 is provided when the container body 11 is maintained in the position.

4. Modifications

The exemplary embodiment described above may be modified as follows.

The exemplary embodiment has been described with reference to an example case in which the whole of the outer periphery of each arc part 27 is formed as an arc. However, at least a part of the outer periphery needs to form an arc which forms a part of a spiral.

The number of the scrape/convey member 23 and the number of arc convey members 24 may be arbitrary numbers. In other words, at least some of the plural convey members need to have substantially the same structure as that of the arc convey members 24. For example, the number of scrape/convey members 23 may be two or more.

Also, in the above exemplary embodiment, arc convey members 24 positioned in the downstream side along the conveyor 20 are configured so that the second support parts 26 have greater flexural rigidity and the first support parts 25 have smaller flexural rigidity. The number of arc convey members 24 which have such a configuration is not limited to eight but may be increased or decreased from eight.

Also in the above exemplary embodiment, connection parts between the second support parts 26 and the rotation shaft 21 are thickened to attain improved strength. However, not only the connection parts but also the entire support parts may be thickened, or hardness of the resin material may be increased to improve the strength of the entire support parts. However, if the strength of the entire support parts is thus raised, stress is concentrated on the bottom parts of the support parts during deformation of the arc convey members 24 although the support parts are durable against a reaction force from the developer. This configuration is therefore less desirable than the above exemplary embodiment in which connection parts between the support parts and the rotation shaft 21 are further thickened.

The structure of the second support parts 26 shown in FIG. 5B may be adopted in the first support parts 25. Otherwise, the support parts 25 and 26 may be fixed to the rotation shaft 21 without reinforcing the support parts 25 or 26. The exemplary embodiment is configured so that each of the arc parts 27 of the arc convey members 24 is supported by two support parts. Each of the arc parts 27 may alternatively be supported by one, three, or more support parts. Similarly, the exemplary embodiment is configured so that the arc part 23D of the scrape/convey member 23 is supported by three support parts. However, the arc part 23D may be supported by one, two, four, or more support parts.

Further, for all of the convey members 23 and 24, a gap is provided between each of the rotation shaft 21, arc part, and support parts. The gaps may have arbitrary sizes. As the gaps are decreased by thickening the arc parts and support parts, conveyance ability further improves. However, a reaction force from the developer increases accordingly, and deformation amounts of the convey members 23 and 24 therefore need to be estimated to be larger. On the contrary, as the gaps are increased by narrowing the arc parts and support parts, conveyance ability decreases. However, a reaction force from the developer decreases accordingly, and deformation amounts of the convey members decrease accordingly.

The central angle (i.e., angular aperture) of the arc part 27 of each arc convey member 24 about the rotation shaft 21 is not limited to 140°. However, the central angle of the arc part 27 about the rotation shaft 21 needs to be 360° or less in order that the arc convey members 24 easily tilt down in a direction of approaching the rotation shaft 21 when the arc convey members 24 receive a reaction force from the developer. If the central angle is 180° or less, a reaction force which a first support part 25 receives from the developer and a reaction force which a corresponding second support part 26 receives from the developer both belong to one identical area which is divided by planes vertical to the rotation shaft 21.

The material of the conveyor 20 is not limited to resins but may be any material insofar as the material has adequate flexibility so that it can bend. The whole conveyor 20 need not be integrally molded but the rotation shaft, arc parts, and support parts may be separately manufactured and then be fixed to each other by any measure such as bonding.

Although the angular aperture of the arc part 23D of the scrape/convey member 23 is set to 360° in the exemplary embodiment, the scrape/convey member 23 may alternatively be configured as a convey member having a smaller angular aperture than 360°. However, this convey member is provided on the rotation shaft 21 in the most upstream side along the conveying direction of the developer. Therefore, the inclination of the arc part relative to the rotation shaft is set to be greater than that of the arc parts 27 of the arc convey members 24. In addition, the outer periphery of the arc part of the convey member is desirably supported at a more distant position from the rotation shaft 21 than the outer periphery of each of the arc parts 27 of the arc convey members 24.

In the above exemplary embodiment, the outer shape of the developer cartridge 10 is defined by the container body 11 and the cap member 17 which covers the opening 14 of the container body 11. However, the invention is not limited to such an outer shape but two openings of a cylindrical member may be covered with caps.

The foregoing description of the exemplary embodiment of the present invention has been provided for the purpose of illustration and description. It is not intended to be exhaustive or to limit the invention to the precise forms disclosed. Obviously, many modifications and variations will be apparent to practitioners skilled in the art. The exemplary embodiment were chosen and described in order to best explain the principles of the invention and its practical applications, thereby enabling others skilled in the art to understand the invention for various embodiments and with the various modifications as are suited to be particular use contemplated. It is intended that the scope of the invention be defined by the following claims and their equivalents.

What is claimed is:

1. A conveyor comprising:

a rotation shaft and a plurality of convey members provided along an axial direction of the rotation shaft, wherein at least one of the plurality of convey members is an arc convey member, the arc convey member including:

a rod-like arc part having an outer periphery that forms an arc forming a part of a spiral so that an angle between two perpendiculars extended from two ends of the arc is smaller than a predetermined angle, the arc part is positioned away from the shaft and its arc is not directly connected to the rotation shaft; and a support part that supports the two ends of the arc, with the outer periphery of the arc part inclined to the axial direction of the rotation shaft, wherein the support part that the arc convey member being the at least one of the plurality of arc convey members includes at least:

a first support part that supports the arc part in a most upstream side along a developer conveying direction; and a second support part that supports the arc part in a downstream side of the first support part along the developer conveying direction, and the second support part has greater flexural rigidity than the first support part.

2. A conveyor comprising:

a rotation shaft and a plurality of convey members provided along an axial direction of the rotation shaft, wherein at least one of the plurality of convey members is an arc convey member, the arc convey member including:

a rod-like arc part having an outer periphery that forms an arc forming a part of a spiral so that an angle between two perpendiculars extended from two ends of the arc is smaller than a predetermined angle, the arc part is positioned away from the shaft and its arc is not directly connected to the rotation shaft; and a support part that supports the two ends of the arc, with the outer periphery of the arc part inclined to the axial direction of the rotation shaft, wherein the support part that the arc convey member being the at least one of the plurality of arc convey members includes at least:

a first support part that supports the arc part in a most upstream side along a developer conveying direction; and a second support part that supports the arc part in a downstream side of the first support part along the developer conveying direction, and a part where the second support part is connected to the rotation shaft is more reinforced than a part where the first support part is connected to the rotation shaft.

3. The conveyor according to claim 1, wherein the arc convey member is provided on the rotation shaft in a most downstream side along the developer conveying direction.

4. A developer cartridge comprising:

a cartridge including a container and an outlet port, the container containing a developer, and the outlet port allowing the developer be output to the outside of the container; and a conveyor including:

a rotation shaft and a plurality of convey members provided along an axial direction of the rotation shaft, wherein at least one of the plurality of convey members is an arc convey member, the arc convey member including:

a rod-like arc part having an outer periphery that forms an arc forming a part of a spiral so that an angle between two perpendiculars extended from two ends of the arc is smaller than a predetermined angle, the arc part is positioned away from the shaft and its arc is not directly connected to the rotation shaft; and a support part that supports the two ends of the arc, with the outer periphery of the arc part inclined to the axial direction of the rotation shaft, the conveyor which is rotated in the container, wherein the container contains an amount of developer in which the whole of the plurality of arc convey members are not buried by developer when the container is maintained in a position such that the axial direction of the rotation shaft of the conveyor is arranged vertically and the outlet port is positioned in a lower side along a direction of gravitational force, wherein the support part that the arc convey member being the at least one of the plurality of arc convey members includes at least:

a first support part that supports the arc part in a most upstream side along a developer conveying direction; and a second support part that supports the arc part in a downstream side of the first support part along the developer conveying direction, and the second support part has greater flexural rigidity than the first support part.

5. The developer cartridge according to claim 4, wherein the support part is bowed out so as to expand toward the downstream side along a rotation direction of the rotation shaft.

6. The developer cartridge according to claim 4, wherein, when viewed from a direction vertical to the axial direction of the rotation shaft, every adjacent arc convey members which are adjacent to each other in the axial direction of the rotation shaft partially overlap one another.

7. A developer cartridge comprising:

a cartridge including a container and an outlet port, the container containing a developer, and the outlet port allowing the developer to be output to the outside of the container; and a conveyor that is rotated in the container to convey the developer and includes a rotation shaft, a plurality of convey members, and a protrusion member, the plurality of convey members provided along an axial direction of the rotation shaft, and the protrusion member provided at a position where the protrusion member is opposed to the outlet port, wherein a plurality of arc convey members are at least one of the plurality of convey members, the plurality of arc convey members each including, a rod-like arc part having an outer periphery that forms an arc forming one part of a spiral so that an angle between two perpendiculars extended from two ends of the arc is smaller than a predetermined angle, the arc part is positioned away from the shaft and its arc is not directly connected to the rotation shaft; and a support part that supports the two ends of the arc, with the outer periphery of the arc part inclined to the axial direction of the rotation shaft, and when viewed from a direction vertical to the axial direction of the rotation shaft, one of the plurality of arc convey members that is positioned in a most downstream side along the developer conveying direction overlaps at least one part of the protrusion member, wherein the support part that the arc convey member being the at least one of the plurality of arc convey members includes at least:

a first support part that supports the arc part in a most upstream side along a developer conveying direction; and a second support part that supports the arc part in a downstream side of the first support part along the developer conveying direction, and the second support part has greater flexural rigidity than the first support part.

8. The developer cartridge according to claim 7, wherein the support part is bowed out so as to expand toward the downstream side along a rotation direction of the rotation shaft.

9. A conveyor comprising:

a rotation shaft and a plurality of convey members provided along an axial direction of the rotation shaft, wherein at least one of the plurality of convey members is an arc convey member, the arc convey member including:

an arc part having an outer periphery that forms an arc forming a part of a spiral so that an angle between two perpendiculars extended from two ends of the arc is smaller than a predetermined angle, the arc part is positioned away from the shaft and its arc is not directly connected to the rotation shaft; and a support part that supports the two ends of the arc, with the outer periphery of the arc part inclined to the axial direction of the rotation shaft, wherein the support part that the arc convey member being the at least one of the plurality of arc convey members includes at least:

a first support part that supports the arc part in a most upstream side along a developer conveying direction; and a second support part that supports the arc part in a downstream side of the first support part along the developer conveying direction, and the second support part has greater flexural rigidity than the first support part.

10. The conveyor according to claim 9, wherein the arc convey member is provided on the rotation shaft in a most downstream side along the developer conveying direction.

* * * * *